US010798480B2

(12) United States Patent
Shi et al.

(10) Patent No.: US 10,798,480 B2
(45) Date of Patent: Oct. 6, 2020

(54) SPEAKER ASSEMBLY AND SPEAKER USING SAME

(71) Applicant: AAC Technologies Pte. Ltd., Singapore (SG)

(72) Inventors: Yang Shi, Shenzhen (CN); Lu Feng, Shenzhen (CN); Shaoyuan Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/056,648

(22) Filed: Aug. 7, 2018

(65) Prior Publication Data

US 2019/0158950 A1 May 23, 2019

(30) Foreign Application Priority Data

Nov. 21, 2017 (CN) ..... 2017 2 1566069 U

(51) Int. Cl.

| | |
|---|---|
| ***H04R 1/02*** | (2006.01) |
| ***H04R 1/28*** | (2006.01) |
| ***H04R 31/00*** | (2006.01) |

(52) U.S. Cl.
CPC ..... *H04R 1/288* (2013.01); *H04R 31/006* (2013.01); *H04R 1/023* (2013.01)

(58) Field of Classification Search
CPC ..... H04R 1/02; H04R 9/025; H04R 9/06
See application file for complete search history.

(56) References Cited

U.S. PATENT DOCUMENTS

| | | | | |
|---|---|---|---|---|
| 9,473,837 | B2 * | 10/2016 | Choi | H04R 1/02 |
| 2010/0316249 | A1 * | 12/2010 | Kamimura | H04R 9/043 381/399 |
| 2014/0301591 | A1 * | 10/2014 | Yang | H04R 1/1016 381/380 |
| 2017/0339476 | A1 * | 11/2017 | Jia | H04R 1/02 |

* cited by examiner

*Primary Examiner* — Amir H Etesam
(74) *Attorney, Agent, or Firm* — IPro, PLLC; Na Xu

(57) ABSTRACT

The present application discloses a speaker assembly. The speaker assembly includes a sound generator having a sound radiation surface and a back surface opposite to the sound radiation surface; at least one leakage area formed on the back surface; at least one leakage controller corresponding to the leakage area and covering the leakage area; a damping element disposed on a plane on which the leakage controller is disposed. The damping element is arranged between adjacent two leakage areas. By the configuration, the height of the speaker assembly is reduced.

6 Claims, 2 Drawing Sheets

SPEAKER ASSEMBLY AND SPEAKER USING SAME

FIELD OF THE PRESENT DISCLOSURE

This disclosure related to the field of electro-acoustic transducers, and more particularly to a speaker assembly and a speaker using the speaker assembly.

DESCRIPTION OF RELATED ART

A speaker related to the present disclosure generally has mesh and foam for adjusting air leakage and further for protecting the speaker and improving the acoustic performance. For fixing the mesh and foam on the back side of the speaker, the mesh is attached to the back side by a double-side adhesive, and the foam is stacked to the mesh by another double-side adhesive.

By the configuration mentioned above, the back cavity of the speaker is reduced and accordingly acoustic performance is badly affected. In addition, using two layer of double-side adhesive is a waste of materials, which increases the cost to manufacture the speaker. Furthermore, multi-layer structure is not beneficial for small size design.

Therefore it is necessary to provide an improved speaker assembly and a speaker using the speaker assembly for overcoming the above-mentioned disadvantages.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
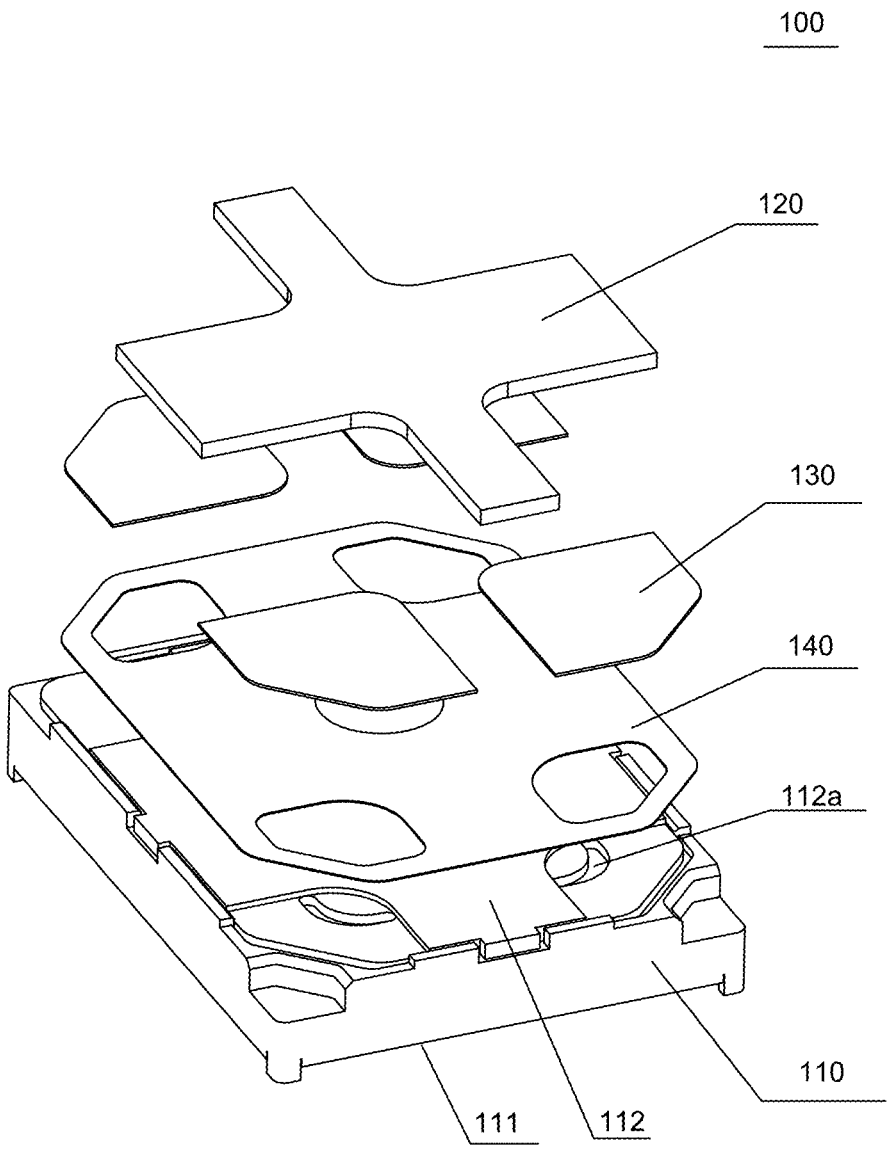
FIG. 1 is an isometric and exploded view of a speaker assembly in accordance with an exemplary embodiment of the present invention.
Figure 2:
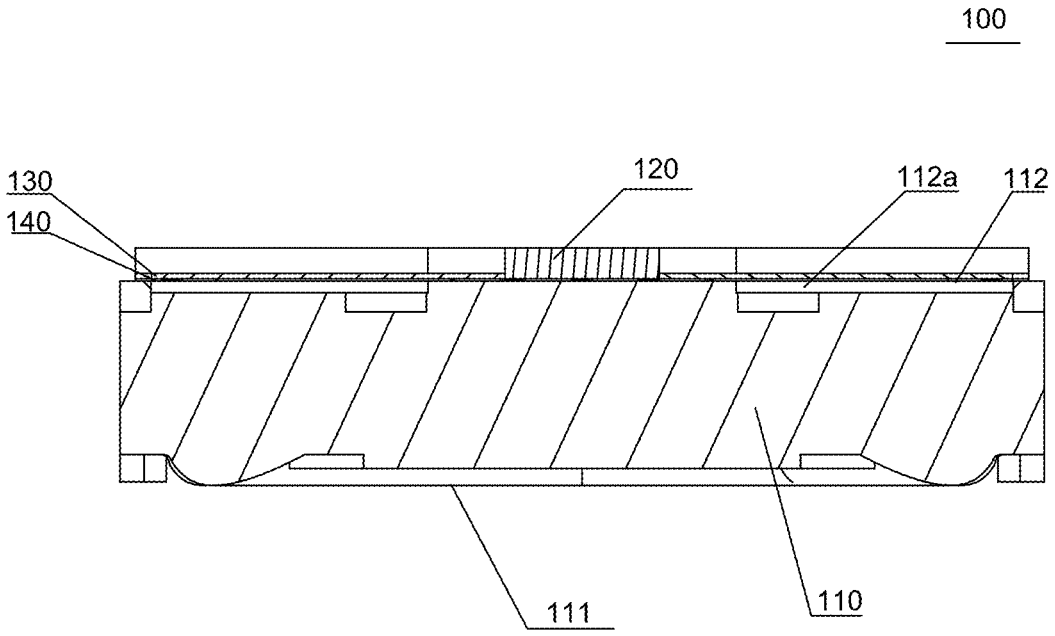
FIG. 2 is a cross-sectional view of the speaker assembly in FIG. 1.

Referring to FIGS. 1-2, a speaker assembly 100, in accordance with an exemplary embodiment of the present disclosure, includes a sound generator 110 having a sound radiation surface 111 and a back surface 112 opposite to the sound radiation surface 111. The back surface 112 forms a plurality of leakage areas 112*a*. The speaker assembly 100 further includes a damping element 120 and a plurality of leakage controller 130 corresponding to the leakage areas 112*a*. The leakage controller 130 covers the corresponding leakage areas 112*a*. The damping element 120 and the leakage controllers 130 are arranged on a common layer, and the damping element 20 is located between the leakage controllers 130.

Especially referring to FIG. 1, the back surface 112 of the sound generator 110 forms a plurality of leakage areas 112*a* spaced from each other. One leakage controller 130 locates above one leakage area 112*a*, and further, a projection of each of the leakage controllers 130 covers completely the corresponding leakage area 112*a*. In addition, between two adjacent leakage controllers 130 locates the damping element 120. Referring to FIG. 2, the thickness of the damping element 120 along the vibration direction of the sound generator 110 is greater than the thickness of the leakage controllers 130 along the vibration direction of the sound generator 110.

In the speaker assembly 100, the leakage controllers 130 are only disposed between the leakage areas 112*a*, and the rest area of the back surface is used to carry the damping element 120. Because the damping element 120 and the leakage controller 130 are disposed on a common layer, a height of the speaker assembly 100 is reduced, and small size requirement is achieved. Meanwhile, by virtue of the configuration mentioned above, back cavity of the speaker assembly is effectively increased, which improves the acoustic performance. In addition, the leakage controller 130 is only disposed corresponding to the leakage areas 112*a*, which reduce the cost to manufacture the speaker assembly 100.

The leakage controller 130 may comprises a mesh. The damping element 120 may comprise foam.

Optionally, referring to FIGS. 1-2, the speaker assembly 100 further includes adhesive layer 140 sandwiched between the back surface 112 and the leakage controller 130 for fixing the leakage controllers 130 and the damping element 120 to the back surface 112. Since the damping element 120 and the leakage controllers 130 are disposed on the same layer, only one layer of adhesive is used for reducing the height of the speaker assembly.

The present disclosure further provides a speaker containing the speaker assembly described above.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker assembly, comprising:

a sound generator having a sound radiation surface and a back surface opposite to the sound radiation surface;

a plurality of leakage areas formed on the back surface;

a plurality of leakage controllers corresponding to the leakage areas and covering the leakage areas;

a damping element disposed on a plane on which the leakage controllers are disposed; wherein the damping element is arranged between adjacent two leakage areas; a thickness of the damping element along the vibration direction of the sound generator is greater than a thickness of the leakage controllers along the vibration direction of the sound generator.

2. The speaker assembly as described in claim 1, wherein the leakage controller comprises mesh.

3. The speaker assembly as described in claim 1, wherein the damping element comprises foam.

4. The speaker assembly as described in claim 1 further including a adhesive layer sandwiched between the back surface and the leakage controller for fixing the leakage controllers and the damping element to the back surface.

5. The speaker assembly as described in claim 1, wherein the adhesive layer is a double-side adhesive.

6. A speaker comprising the speaker assembly as described in claim 1.

* * * * *